United States Patent [19]

Satterwhite

[11] 3,974,580

[45] Aug. 17, 1976

[54] ALL ELECTRIC EXCAVATING AND LOADING SYSTEM

[75] Inventor: Charles R. Satterwhite, Dallas, Tex.

[73] Assignee: Unit Rig & Equipment Co., Tulsa, Okla.

[22] Filed: July 17, 1975

[21] Appl. No.: 596,577

Related U.S. Application Data

[63] Continuation-in-part of Ser. No. 435,296, Jan. 21, 1974, Pat. No. 3,896,571.

[52] U.S. Cl. ..... 37/189; 37/190; 37/95

[51] Int. Cl.[2] ..... E02F 3/24

[58] Field of Search ..... 37/189, 190, 94–97, 37/91, 87, DIG. 2; 296/6, 71, 73, 76–78; 307/9; 180/65 R, 65 F

[56] References Cited

UNITED STATES PATENTS

| | | | |
|---|---|---|---|
| 818,215 | 4/1906 | Anderson | 37/95 |
| 853,985 | 5/1907 | Linga | 37/94 |
| 2,622,351 | 12/1952 | Walters | 37/190 |
| 2,762,141 | 9/1956 | Le Tourneau | 37/190 |
| 3,091,874 | 6/1963 | Wuigk | 37/190 B |
| 3,157,438 | 11/1964 | Lundquist | 299/73 |
| 3,290,096 | 12/1966 | Stalker | 299/78 |
| 3,487,565 | 1/1970 | Grandin | 37/189 |
| 3,500,565 | 3/1970 | Smith | 37/190 |
| 3,712,679 | 1/1973 | Amoroso | 299/76 |

FOREIGN PATENTS OR APPLICATIONS

| | | | |
|---|---|---|---|
| 722,876 | 3/1932 | France | 37/190 B |
| 968,959 | 4/1958 | Germany | 37/190 B |
| 137,833 | 10/1956 | U.S.S.R. | 37/190 |

*Primary Examiner*—E. H. Eickholt
*Attorney, Agent, or Firm*—Richards, Harris and Medlock

[57] ABSTRACT

An excavating and loading system including an excavating wheel assembly at the front thereof and a plurality of conveyors for conveying material from the excavating wheel assembly upwardly and rearwardly. The excavating wheel assembly includes a plurality of excavating wheels having an overall width in excess of that of the following portion of the system. A supporting and housing apparatus rotatably supports the excavating wheel assembly and includes portions which extend between adjacent excavating wheels. Electric motors are connected to drive shafts which extend to the excavating wheel assembly through the portions of the supporting and housing apparatus that extend between adjacent excavating wheels. A right angle gearbox is connected to each drive shaft and powers the excavating wheel through a planetary speed reducer. Apparatus is provided for raising and lowering the excavating height of the excavating wheel assembly to thereby vary the grade of the excavation. The excavating wheel is provided with means for positively moving the walls of a plurality of buckets between digging and dumping positions.

18 Claims, 8 Drawing Figures

ALL ELECTRIC EXCAVATING AND LOADING SYSTEM

CROSS REFERENCE TO RELATED APPLICATION

This application is a continuation-in-part of copending application, Ser. No. 435,296, filed Jan. 21, 1974, for MULTI-WHEELED EXCAVATION AND CONVEYING SYSTEM, now U.S. Pat. No. 3,896,571, granted July 29, 1975.

BACKGROUND OF THE INVENTION

The present invention relates to improvements in excavating and loading systems which form an excavation of a sufficient width to allow the following portion of the system to move through the excavation. In large excavating and loading systems, for example, of the type capable of loading 4,000 cu. yds. of earth per hr., it has heretofore been known to utilize a system which forms a trench in the ground of a sufficient width to allow the system to move through the trench behind the excavating portion of the system. Although various examples of such excavating and loading systems have been designed previously, the need persists for considerable improvement in the art.

In accordance with the broader aspects of the present invention, an improved excavating and loading system is disclosed including a vehicle with an excavating wheel assembly supported at the front of the vehicle. The excavating wheel assembly is wider than the following portion of the vehicle and forms an excavation which is wider than the portion of the vehicle positioned in the excavation. Supporting and housing apparatus is mounted on the front of the vehicle for supporting the excavating wheel assembly therefrom. The system is powered by an internal combustion engine which drives a generator and hydraulic pump system. At least one electric motor is positioned on the vehicle and a drive shaft extends from the electric motor to gearing within the excavating and loading wheel assembly for effecting rotation of the assembly.

In accordance with the preferred embodiment of the invention, an improved excavating and loading system is disclosed having a vehicle which comprises a main frame supported from the ground surface by a pair of wheels. A subframe supports a pair of tired wheels and is pivotally connected to the main frame. A double-acting hydraulic cylinder controls the relative pivotal movement between the frame and the subframe, whereby the main frame may be raised and lowered by pivoting the subframe with respect thereto. Supporting and housing apparatus rotatably supports an excavating wheel assembly at the front of the vehicle. The supporting and housing apparatus has a bifurcated portion which extends between adjacent wheels of the excavating wheel assembly. A motor generator assembly is mounted on the subframe. At least one electric motor drives the excavating wheels through drive shafts extending through the bifurcated portion and coupled to right angle gear drives and speed reducers. A blade and bearing plate are connected to the lower portions of the main frame for stabilizing the excavating wheel assembly. The excavating wheel assembly includes a plurality of wheels, each having digging buckets each including a wall which is supported for pivotal movement between a material receiving position and the material dumping position. Structure is provided for operating the movable wall of each bucket to first receive material and to subsequently dump the material onto a main conveyor. A main conveyor is mounted on the vehicle to receive material from the excavating wheel assembly and to transport the material upward and rearward. An auxiliary conveyor with inner and outer portions can be provided on the rear of the vehicle for receiving material from the main conveyor and transporting material rearwardly and laterally.

DESCRIPTION OF THE DRAWINGS

A more complete understanding of the present invention may be had by referring to the following Detailed Description when taken in conjunction with the accompanying Drawings wherein.

DETAILED DESCRIPTION

Figure 1:
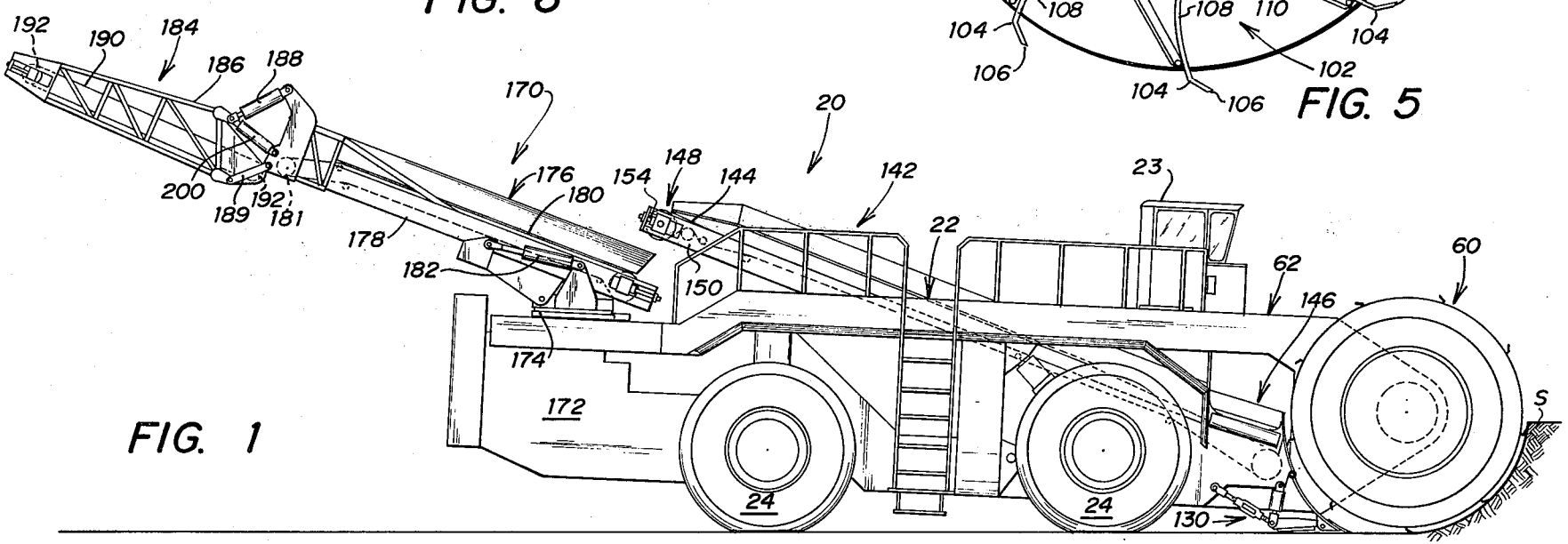
FIG. 1 is a side elevation of the excavating and loading system comprising the present invention.

Referring now to the Drawings, and particularly to FIG. 1, an excavating and loading system 20 incorporating the invention is shown. The system 20 comprises a vehicle 22 with an operator cab 23 and rear tired type wheels 24 and front tired wheels 26. Each of the wheels 24 is adapted for movement over highways or other paved surfaces as well as for operation in unpaved areas, such as during the excavating operation. It is to be understood, of course, that other types of wheel such as endless track type wheels could be utilized with the system.

In the preferred embodiment, the rear wheels 24 are motorized wheels such as those that utilize a magnetic frame of the motor to support the vehicle as well as to serve as a magnetic structure of the motor. This type of wheel minimizes the overall vehicle width. These wheels are well known in the art and are presently manufactured by General Electric and sold as motorized wheels, model number 5 GE 772.

Figure 2:
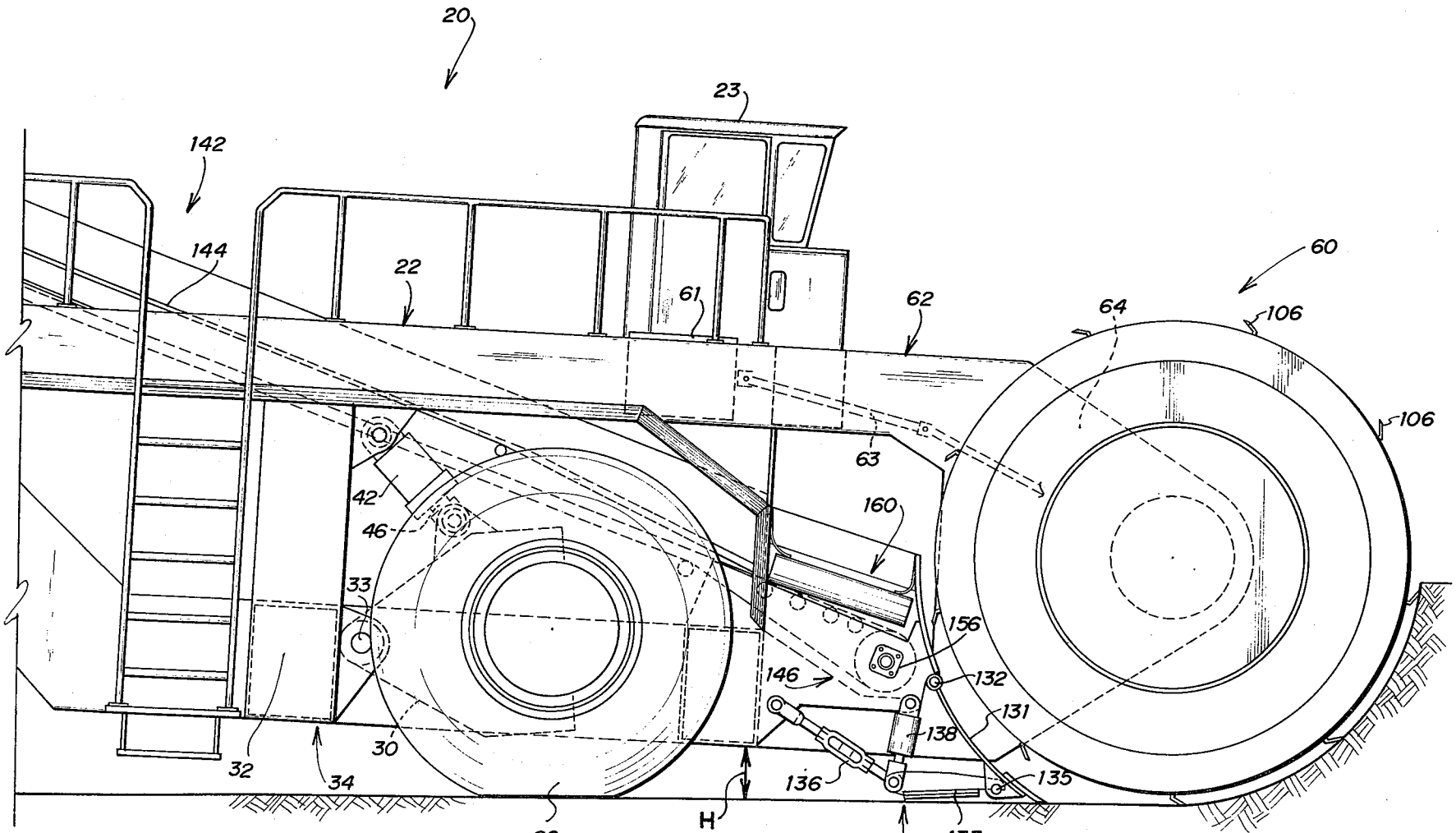
FIG. 2 is a partial enlarged side elevation of the front portion of the excavating and loading system illustrated in FIG. 1.
Figure 3:
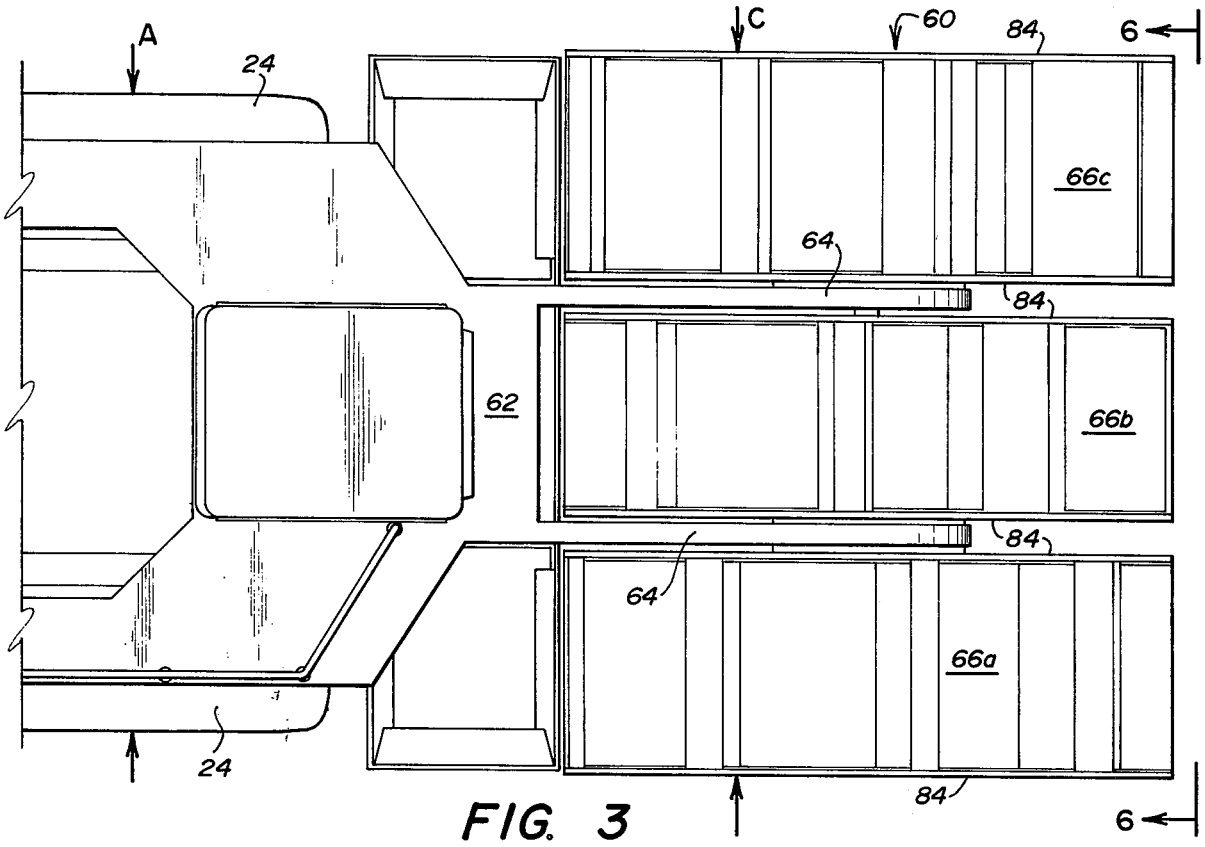
FIG. 3 is a partial enlarged plan view of the front portion of the excavating and loading system illustrated in FIG. 2.

As illustrated in FIG. 2, front wheels 26 are pivotally connected to frame 30. Frame 30 is in turn pivotally connected to a subframe 32 at horizontally extending axis 33. A pair of double-acting hydraulic cylinder assemblies 42 are pivotally connected between the frame 30 and subframe 32. The rod 46 of the hydraulic cylinder assembly 42 is connected to the frame 30. By selectively actuating the hydraulic cylinder assemblies 42, the height H of the front end 34 of the subframe 32 can be raised or lowered.

In accordance with the illustrated embodiment of the invention, an engine and generator (not shown) is supported on the subframe 32. The engine can be a Cummins model number VTA 1710 C 700 and the generator a General Electric model number 5 GT 603. In addition, the engine can be coupled to power hydraulic pumps, air compressors and the like. The air compressors are provided for the conventional braking systems present on the vehicle. The hydraulic pumps, in turn, supply operating power through suitable controls in cab 23 for the various hydraulically operated systems of the excavating and loading system 20.

An excavating wheel assembly 60 is positioned on the forward portion of the vehicle 22. A pair of electric motors 61 are mounted on the subframe 32 and supply power to drive the excavating wheel assembly 60 through drive shafts 63. The excavating wheel assembly 60 includes a supporting and housing apparatus 62 extending from the front of the subframe 32.

The support housing apparatus comprises a pair of plates which rigidly extend from the subframe 32. The plates 64 are positioned in a vertically extending spaced arrangement. The excavating wheel assembly 60 is supported from the plates 64 to rotate about a horizontal axis. Drive shafts 63 extend through the plates 64 and supply power to the excavating wheel assembly 60, as will be hereinafter described in detail.

Figure 4:
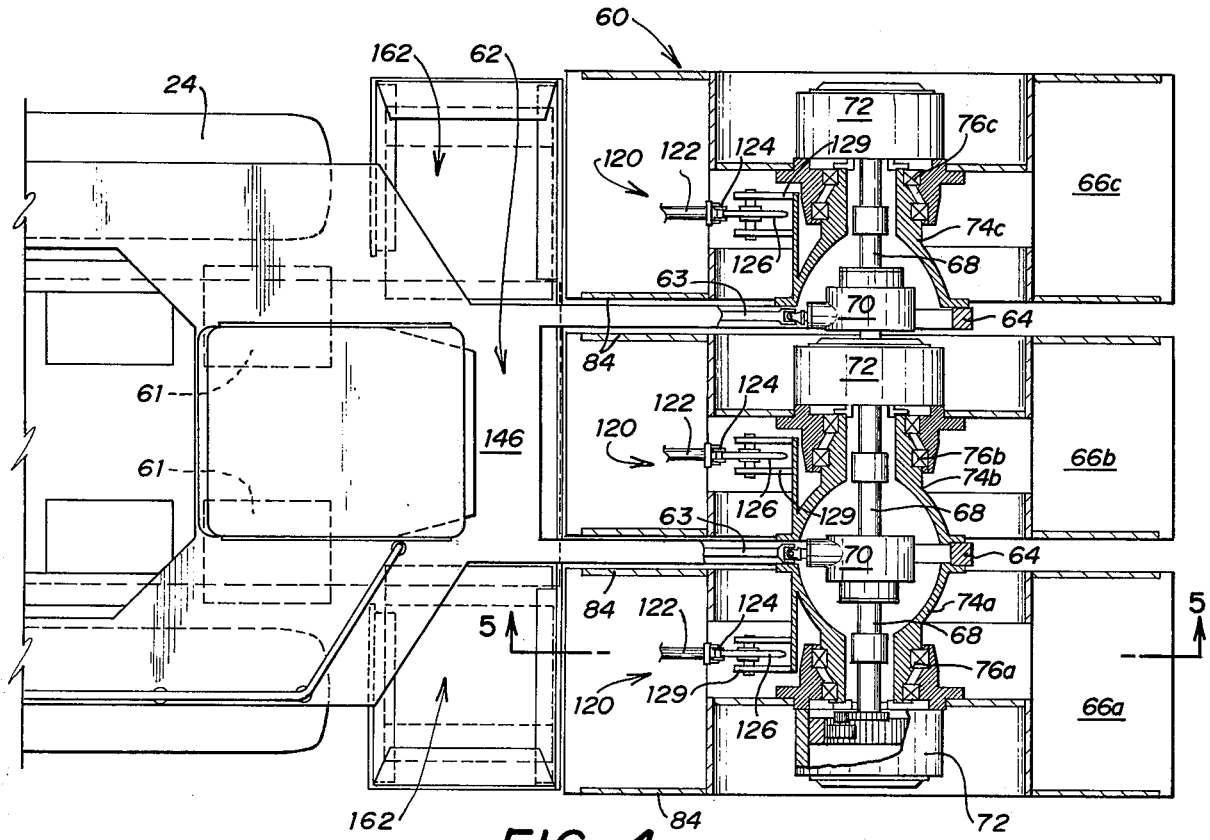
FIG. 4 is a plan view partially in section similar to FIG. 3.

In FIGS. 3, 4, 5 and 6, the details of the excavating wheel assembly 60 are shown. The assembly 60 comprises three excavating wheels 66*a*, 66*b* and 66*c* each of which are rotatably supported from the plates 64 by shafts 68. The shafts 68 are driven by shafts 63 which are coupled to shaft 68 through right angle drive assemblies 70, as best illustrated in FIG. 4. The wheels 66*a*, 66*b* and 66*c* are each connected to the shafts 68 through planetary gear speed reducers 72. Housings 74*a*, 74*b* and 74*c* are supported from plates 64 respectively within the excavating wheels 66*a*, 66*b* and 66*c*. Bearing assemblies 76*a*, 76*b* and 76*c* support the wheels 66*a*, 66*b* and 66*c* respectively, from the housings 74*a*, 74*b* and 74*c*. In this manner, each of the wheels 66*a*, 66*b* and 66*c* is mounted to rotate about a horizontal axis extending through the center of shaft 68.

Each excavating wheel 66 of the excavating wheel assembly includes a pair of rims 84 which extend radially outward along the sides of the wheels. Rims 84 define the overall width of each wheel 66. Each of the rims 84 is rotatably supported from one of the housings 74 by bearings 76*a*, 76*b* or 76*c*.

In the disclosed embodiment, two drive shafts 63 and two motors 61 are provided. It is to be understood, of course, that a single motor and drive shaft could be used to power the shaft 68 through a single right angle drive 70. As is illustrated in detail in FIG. 5, each of the wheels 66 further comprises a plurality of digging buckets 102 which are equally spaced circumferentially around the wheels 66 and extend between the rims 84. The digging buckets 102 each have a cutting edge 104 and a plurality of teeth 106 and a stationary wall 108, extending generally radially inward from the cutting edge 104. Each digging bucket further includes a rear wall 110, which is supported for pivotal movement between a material receiving position and a material discharge position.

Figure 5:
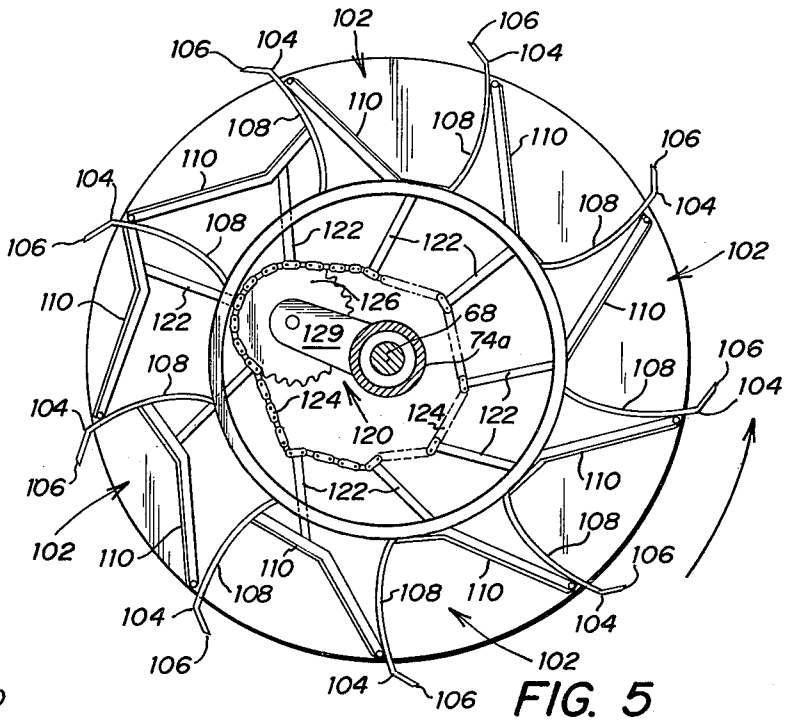
FIG. 5 is a section of the system for actuating the rear plates of the digging buckets of the excavating and loading system taken on line 5—5 of FIG. 4.

Operation of the rear wall 110 is best illustrated in FIG. 5, wherein the wall 110 is shown manipulated between a material receiving position where the respective buckets 102 are in the lower and forward position of their rotary motion and a material discharge position where the respective buckets are in the upper and rearward positions of their rotary motion.

Referring particularly to FIGS. 4 and 5, an actuating system 120 for the digging buckets 102 is shown. The system 120 is located completely within the margins of one of the wheels 66 and comprises a plurality of push rods 122, each of which is connected between one of the rear walls 110 and a chain 124. The chain 124 is generally unconstrained, but extends around a roller 126 which is supported from one of the housings 74 by brackets 129. The roller 126 is sprocketed on its outer periphery to engage the chain 124. As the excavating wheels 66 are rotated about the shaft 68 under the action of the motors 61, each push rod 122 comes into engagement with the roller 126 whereupon its respective rear wall 110 is pushed outwardly into the material dumping position. Subsequently, as each digging bucket is rotated to the lower and forward portion of the circular path. The chain operates through the push rod 122 to positively return the rear wall 110 to the material digging position. This positive actuation of the rear wall 110 in both directions has been found to be vastly superior to the arrangements that have been used heretofore wherein rear portions of digging buckets were allowed to return to the digging position under the action of gravity and/or crowding of excavated material into the buckets. It is envisioned, of course, that other positive actuating systems could be used, such as those described in the earlier copending application, Ser. No. 435,296, filed Jan. 21, 1974, for Multi-Wheeled Excavator and Conveying System, now U.S. Pat. No. 3,896,571, granted July 29, 1975, the disclosure of which is incorporated herein by reference.

Positioned below and behind the excavating wheel assembly 66 is a moldboard assembly 130. The moldboard assembly 130 is connected to the subframe 32, as is illustrated in FIG. 2. The embodiment utilizes an elongated blade 131, which is pivotally attached at 132 behind the excavating wheel assembly 60. A drag plate 133 is pivotally attached at 135 to the blade 131. A variable length member, such as turnbuckle 136, is pivotally attached between the drag plate 133 and the subframe 32. A selectively operable hydraulic cylinder 138 is connected between subframe 32 and the plate 133.

The moldboard assembly 130 is mounted on the subframe 32 of vehicle 22 and can be raised and lowered as the vehicle is raised and lowered. The orientation of the blade is not changed by the raising and lowering of the excavating wheel assembly 60. The position of the blade 131 and the drag plate 133 are selectively controlled by operation of hydraulic cylinder 138. If the cylinder 138 is actuated and elongated, the blade 131 is moved downward, increasing the pressure on the plate 133. If the cylinder 138 is shortened in length, the plate 131 will be raised and the pressure of drag plate 133 will be reduced. Thus, by manipulating control means provided in the cab 23, the effective length of the hydraulic cylinder 138 can be selectively varied to appropriately position the bearing or drag plate as desired. This bearing or drag plate can be adjusted to set the vertical pressure to reduce bouncing and stabilize the excavating system.

As is illustrated in FIGS. 1 and 2, the excavating and loading system 20 further includes a loading system 140. The loading system 140 includes a main conveyor 142 comprising an endless belt 144 mounted for movement around the course extending angularly upward relative to the subframe 32 of the vehicle 22 and including a lower material receiving portion 146 and an upper material delivery portion 148. More particularly the course of the belt 144 is defined by a plurality of rollers (not shown) enclosed which are supported on a conveyor frame 150. The conveyor frame 150 is supported from the frame 30 of the vehicle 22 and includes means supporting the upper portion 148 for movement about a horizontal axis under the action of a hydraulic cylinder (not shown). This permits control of the vertical height and allows folding the material delivery portion 148 of the conveyor 142.

Belt 144 of the main conveyor 142 extends around a drum 154 mounted at the upper end of the frame 150 and around the drum 156 on the subframe 132. The upper and lower drums are rotated by radial hydraulic motors (not shown). By this means, the belt 144 is moved around the course defined by the rollers to move material from the material receiving portion 146 to the material discharge or delivery portion 148.

A chute 160 is supported from the subframe 32 behind and below the excavating wheel 66 to receive material discharged from the buckets 102. The chute 160 is shaped to direct material onto the material receiving portion 146 of the main conveyor 142. This chute 160 transfers material excavated by the wheels 66 onto the main conveyor 142 for transportation thereby from the material receiving portion 146 to the material delivery portion 148. In addition a pair of transversely extending conveyors 162 can be positioned behind the excavating wheels 66*a* and 66*c* to move material toward the center of the material receiving portion 146.

Referring now particularly to FIG. 1, the disclosed embodiment of the invention further includes an an auxiliary conveyor system 170. The auxiliary conveyor system 170 includes a frame 172 which is secured to the rear end of the subframe 32 of the vehicle 22. A turntable 174 is supported on the frame 172 for pivotal movement about a vertical axis under the action of a hydraulic motor (not shown).

An inner conveyor 176 is supported on the turntable 174 to receive materials discharged from the material delivery portion 148 of the main conveyor 142. The conveyor 176 comprises a frame 178 which is supported on the turntable 174 and an endless belt 180 mounted around a course defined by a plurality of rollers. The belt 180 is driven by a hydraulic motor 181, and a hydraulic cylinder 182 is provided for controlling the angular relationship of the frame 178 to the turntable 174.

The auxiliary system 170 further includes an outer conveyor 184 comprising a frame 186 which is supported from the frame 178 by upper and lower parallel links 188 and 189. In the present embodiment the upper parallel link 188 is a variable length double-acting hydraulic cylinder. An endless belt 190 is supported on a frame 196 for movement around a course defined by a pair of drums 192. The conveyor 184 is driven by a small hydraulic motor (not shown) mounted in the drums 192.

A hydraulic cylinder 200 is pivotally connected between the frames 178 and 186 to manipulate the conveyor 184 with respect to the inner conveyor 176. In this manner, the outer conveyor 184 may be manipulated to selectively receive material from the inner conveyor 176. By manipulating hydraulic cylinder 182 the angular relationship of the frames 186 and 178 can be altered as desired.

Figure 6:
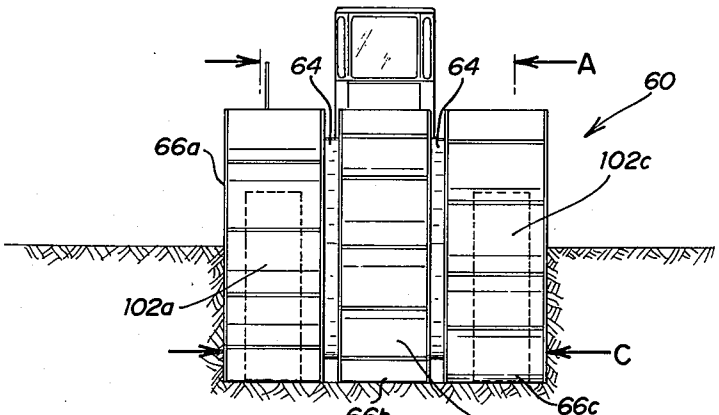
FIG. 6 is a front view taken on line 6—6 of FIG. 3, looking in the direction of the arrows.

In operation, the excavating and loading system 20 incorporated in the present invention, will be moved to the site by means of wheels 24. Hydraulic cylinder 42 will be adjusted at the site so that the excavating wheel assembly 60 will excavate at the desired depth. The moldboard assembly 130 will be adjusted at the desired position by operation of the cylinder 138. Thereafter, excavating wheels 66 can be rotated to excavate material from in front of the vehicle. As illustrated in FIG. 6, this excavation area will have a width C greater than the width A of the following portion of the excavating and loading system 20, and thus the excavating and loading system 20 can move through the excavation formed by the excavating wheel assembly 60. It will also be appreciated by those of ordinary skill in the art that the moldboard assembly 130 will operate to remove any material left unexcavated in the spaces between excavating wheels 66 and crowd the material forward and into the excavating wheels 66.

The material thus excavated is then lifted onto the material receiving portion of the main conveyor 146 and is moved upward and rearward and is discharged over the material discharge end 148 and onto the auxiliary conveyor 170. The material is thereafter conveyed by the auxiliary conveyor 170 upward and rearward where it can be dumped into a hauling vehicle as desired.

A particular feature of the present invention is illustrated in FIG. 6. In this Figure, it can be seen that the wheels 66*a*, 66*b* and 66*c* are positioned so that their respective buckets 102*a*, 102*b* and 102*c* are angularly spaced from each other. This angular spacing of the buckets reduces the torque required to operate the excavating wheel assembly because the individual wheels are not operating in the same mode simultaneously.

Figure 7:
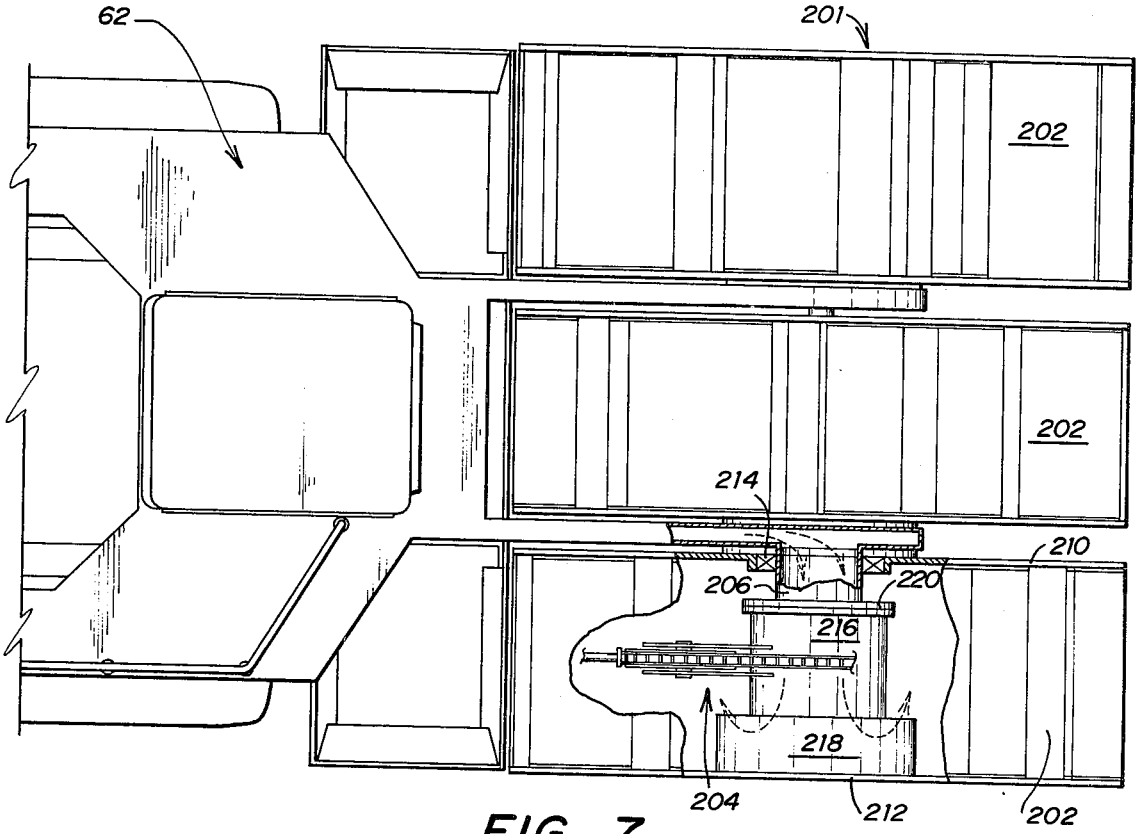
FIGS. 7 and 8 illustrate views similar to FIG. 4 of alternate configurations of the excavating wheel assembly.

In FIG. 7, an alternate configuration of the excavating wheel assembly is illustrated. The second embodiment of the excavating wheel assembly 201 is carried by the supporting and housing apparatus 62. The excavating wheel assembly 201 comprises three excavating wheels 202 each having a plurality of digging buckets (not shown) which are identical in construction to the digging buckets 102 on the wheels 66. In addition, a bucket actuating system 204 is provided for moving the walls of the digging buckets. This system 204 is identical in construction to the bucket actuation system illustrated in FIGS. 4 and 5 as described above. Each of the wheels 202 is identical to the wheel 82 in all respects except the driving means.

As can be seen, the wheels 202 are supported from a hollow shaft 206, whch extends from the supporting and housing apparatus 62. Wheels 202 have rims 210 and 212 which are rotatably supported from shaft 206 by bearings 214.

A direct current electric motor 216 is connected to a gearbox 218 positioned inside the wheels 202 and supported on the shaft 206. Suitable electric conductors (not shown) are connected to the motor 216 and extend through the apparatus 62 to the cab 23. Conventional controls are provided in the cab 23 for controlling the operation of the motor 216.

The motor 216 has a housing with an end plate 220 which is fixed to the shaft 206. The gearbox 218 is in turn supported between the motor 216 and the rim 212. The bucket actuation system 204 is supported on the exterior of the housing of the motor 216, as shown.

The motor 216 is operably connected to gearbox 218. The gearbox 218 is conventional in design and provides a speed reducing function for the output of the motor 216. A planetary gear provides the output from the gearbox 218 and this planetary gear (not shown) is coupled to the rim 212. In this manner, motor 216 drives the gearbox 218 which in turn rotates the wheels 202 through the rim 212. Thus, an electrical motor 216 is used to drive the wheels 202.

According to another feature of this embodiment, cooling air is supplied in the motor 216 through the supporting and housing appparatus 62 as shown. Conduits (not shown) are provided in the apparatus 62 and communicate with the hollow interior of the wheel engaging portion thereof. A blower can be provided to force air through the conduits into the interior of the supporting and housing apparatus 62.

Figure 8:
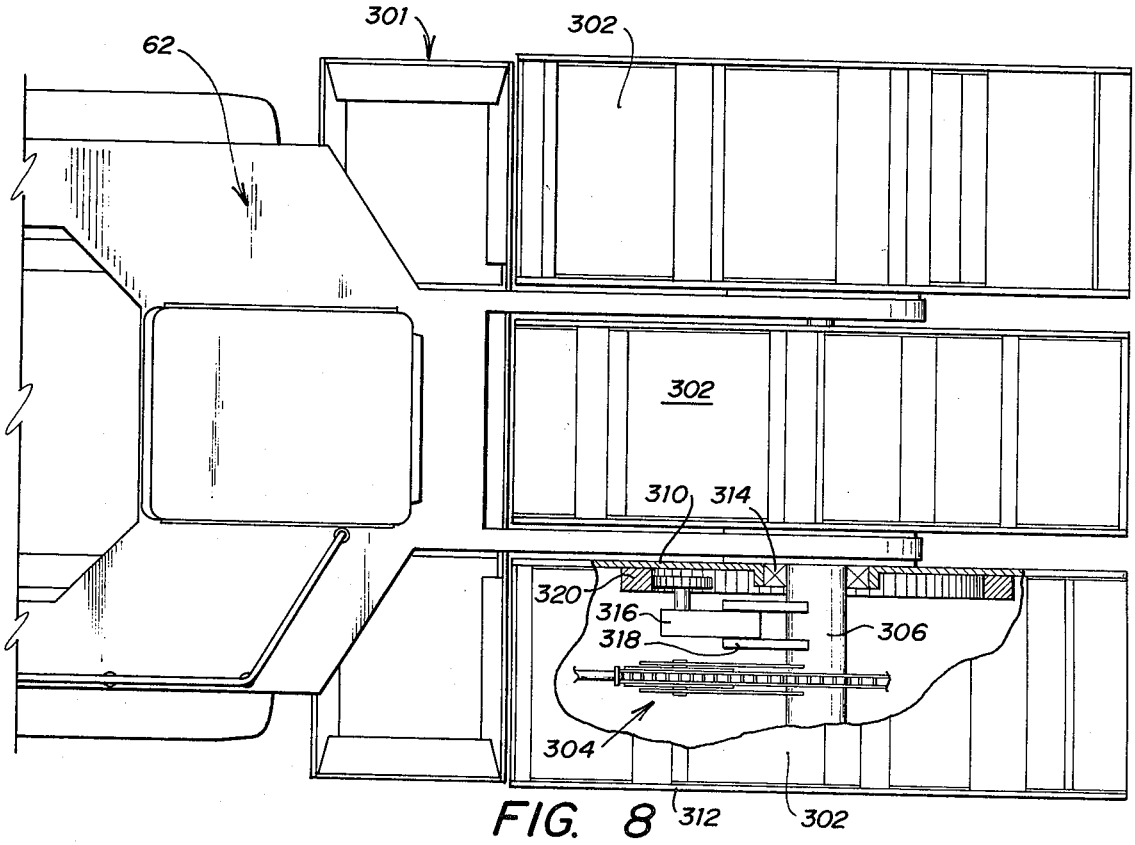

Another configuration of the excavating wheel assembly is illustrated in FIG. 8. This embodiment of the excavating wheel assembly 302 is secured to the supporting and housing apparatus 62 and contacts the wheel engaging portion thereof. The excavating and wheel assembly 301 comprises three excavating wheels 302. These excavating wheels 302 comprise a plurality of digging buckets which are identical in construction to the buckets 102 on the wheels 66.

In addition, a bucket actuation system 304 is provided for moving the walls of digging buckets. The system 304 is identical in construction to the bucket actuation system illustrated in FIGS. 4 and 5 described above.

The wheels 302 are identical to wheels 66 in all aspects except in the driving means. The wheels 302 illustrated in FIG. 8 are each supported from a shaft 306 that extends from supporting and housing apparatus 62. Wheel 302 has rims 310 and 312 which are supported from shaft 306 by bearings 314. An internal ring gear 320 is likewise positioned inside the wheels 302 adjacent to the rim 310. An electric motor 316 is supported from shaft 306 by brackets 318. The motor 316 is provided with an output sprocket which engages ring gear 320 to drive the wheel 302. Electrical lines communicating with the motor 316 are positioned to extend through the supporting and housing apparatus 62.

From the foregoing, it would be understood that the present invention comprises additional improvements relating to the excavating and loading system disclosed and claimed in copending application, Ser. No. 435,296, filed Jan. 21, 1974, for MULTI-WHEELED EXCAVATION AND CONVEYING SYSTEM, now U.S. Pat. No. 3,896,571, granted July 29, 1975.

Thus, in accordance with the invention described herein, an excavating and loading system comprising the vehicle having an excavating wheel assembly for excavating the material and transferring the material to a main conveyor whereupon the material is conveyed to the rear of the vehicle. A bifurcated supporting and housing means supports the excavating wheel assembly from the front of the vehicle. The excavating wheel is driven by electrical motors with drive shafts extending through the bifabricated portion. The excavating wheel assembly is wider than the following portion of the vehicle, thus allowing the vehicle to be supported from and travel through the excavation as it is formed.

This arrangement also increases the width of the excavation formed and permits operation of the excavating and loading system in the excavation. This materially reduces the amount of movement of the excavating wheel assembly necessary to position the assembly for excavation and travel and thereby reduces the overall complexity of the excavating and loading system incorporated in the present invention.

It is to be understood, of course, by those of ordinary skill in the art, that although the vehicle is illustrated with conventional tire-type wheels, track-type wheels could be utilized.

It is also envisioned that suitable apparatus could be mounted on the front of the vehicle 22 to provide pitch and roll adjustment for the excavating wheel assembly 60. This apparatus could simultaneously move the conveyor 142, chute 160 and moldboard assembly 130 as a unit with the excavating wheel assembly 60 to minimize clearance between these elements and reduce spillage.

Although particular embodiments of the invention have been illustrated in the accompanying Drawings and described in the foregoing Detailed Description, it will be understood that the invention is not limited to the embodiments disclosed, but is capable of numerous rearrangements, modifications, and substitution of parts and elements without departing from the spirit and scope of the invention as defined in the appended claims.

What is claimed is:

1. An excavating and loading system comprising:

an excavating wheel assembly comprising axle means and at least two rigid excavating wheels rotatably mounted cantilever on and supported on the axle means, said excavating wheel assembly having a width at least equal to the widest portion of the remainder of the system;

each of said excavating wheels including a plurality of digging buckets located immediately adjacent one another to define the entire circumference of the excavating wheel, each bucket having a cutting edge which extends to a stationary wall, and a wall mounted for pivotal movement from a material receiving position to a material dumping position;

supporting and housing means extending between the excavating wheels and connected to the axle means for supporting the excavating wheel assembly;

each of said digging buckets extending continuously between a side wall thereof located immediately adjacent to the supporting means and a side wall thereof defining one end of the excavating wheel assembly;

drive means including at least one electric motor and speed reducer means drivingly connecting the electric motor to the excavating wheel assembly for rotating the excavating wheels so that the digging buckets follow a circular path;

means located within the margins of the excavating wheel assembly and responsive to rotation of the excavating wheels for positively positioning the movable wall of each digging bucket of the excavating wheels in the material dumping position when the bucket is in the upper and rearward portion of the path;

a vehicle for supporting and manipulating the excavating wheel supporting means and thereby positioning the excavating wheel assembly in engagement with material to be excavated;

an engine mounted on the vehicle;

an electrical generator mounted on the vehicle and driven by the engine for supplying operating power for the electric motor; and conveyor means mounted on the vehicle entirely behind the excavating wheel assembly for movement around a course including a relatively low portion positioned to receive material from the digging buckets of the excavating wheels upon the positioning of the movable walls of the buckets in the material dumping position and a relatively high material delivery portion located rearwardly on the vehicle for the low portion.

2. The excavating and loading system according to claim 1 wherein the drive means is further characterized by:

drive shaft means driven by the electric motor and extending between the excavating wheels of the excavating wheel assembly;

right angle drive means having an input drivingly connected to the drive shaft and having dual outputs extending substantially perpendicularly to the drive shaft into the excavating wheels;

the speed reducer means comprising means mounted within each excavating wheel and drivingly interconnecting the output of the right angle drive means and the surrounding excavating wheel to effect rotation of the excavation wheels under the action of the drive shaft.

3. The excavating and loading system according to claim 1 wherein the drive means is further characterized by a plurality of electric motors each mounted within one of the excavating wheels of the excavating wheel assembly and individual thereto, and a plurality of speed reducer means each drivingly interconnecting one of the electric motors and its associated excavating wheel to effect rotation of the excavating wheel under the action of the electric motor.

4. The excavating and loading system according to claim 3 wherein each of the speed reducer means comprises a planetary gearset mounted within one of the excavating wheels and drivingly interconnecting the excavating wheel and the electric motor associated therewith.

5. The excavating and loading system according to claim 3 wherein each of the speed reducer means comprises a pinion mounted on the output of one of the electric motors and a ring gear mounted within the associated excavating wheel and drivingly engaging the pinion.

6. The excavating and loading system according to claim 1 wherein the vehicle is further characterized by a plurality of wheels supporting the vehicle for movement over a surface, and electric propulsion means operatively connected to the wheels for propelling the vehicle and the excavating wheel assembly carried thereby.

7. An excavating and loading system comprising:

an excavating wheel assembly comprising axle means and three rigid excavating wheels rotatably supported on the axle means, said excavating wheel assembly having a width at least equal to the widest portion of the remainder of the system;

each of said excavating wheels including a plurality of digging buckets, each bucket having a cutting edge which extends to a stationary wall, and a wall mounted for pivotal movement from a material receiving position to a material dumping position;

supporting and housing means extending between the excavating wheels and connected to the axle means for supporting the excavating wheel assembly;

said three excavating wheels including a center excavating wheel comprising digging buckets spanning continuously between points immediately adjacent to the supporting and housing means and two side excavating wheels each comprising digging buckets spanning continuously from points immediately adjacent to the supporting and housing means to points defining the outer ends of the excavating wheel assembly;

means including at least one electric motor and speed reducer means for rotating the excavating wheels so that the digging buckets follow a circular path;

means located within the margins of the excavating wheel assembly and responsive to rotation of the excavating wheels for positively positioning the movable wall of each bucket of the excavating wheels in the material dumping position when the bucket is in the upper and rearward portion of the path;

a vehicle for supporting and manipulating the excavating wheel supporting means and thereby positioning the excavating wheel assembly in engagement with material to be excavated;

an engine mounted on the vehicle;

an electrical generator mounted on the vehicle for supply operating power to the electric motor;

conveyor means mounted on the vehicle behind the excavating wheel assembly for movement around a course including a relatively low portion positioned to receive material from each digging bucket of the center excavating wheel upon the positioning of the movable wall of the bucket in the material dumping position and a relatively high material delivery portion located rearwardly on the vehicle from the lower portion; and means positioned on the vehicle behind the excavating wheel assembly to receive material from each digging bucket of the outside excavating wheels upon the positioning of the movable wall of the bucket in the material dumping position and for directing the material to the conveyor means.

8. The excavating and loading system according to claim 7 wherein the vehicle further comprises a main frame, means supporting the main frame for movement over a surface, and at least one electric motor operatively connected to the supporting means for propelling the vehicle.

9. The excavating and loading system according to claim 7 wherein the drive means is further characterized by:

a pair of electric motors;

a pair of drive shafts each drivingly connected to one of the electric motors and each extending between the center excavating wheel and one of the two side excavating wheels of the excavating wheel assembly;

a pair of right angle drive means each drivingly connected to one of the drive shafts and each having dual outputs extending substantially transversely to the drive shafts and into the excavating wheels; and the speed reducer means comprising three speed reducer devices each individual to and mounted within one of the excavating wheels and each drivingly interconnecting at least one of the outputs of the right angle drive means and the surrounding excavating wheel to effect rotation of the excavating wheel under the action of the electric motor.

10. The excavating and loading system according to claim 7 wherein the drive means is further characterized by three electric motors each mounted within one of the excavating wheels of the excavating wheel assembly and individual thereto, and three speed reducer devices each mounted within one of the excavating wheels of the excavating wheel assembly and individual thereto, and each drivingly interconnecting the associated electric motor and the associated excavating wheel to effect rotation of the excavating wheel under the action of the electric motor.

11. The excavating and loading system according to claim 10 wherein each of the speed reducer means comprises a planetary gearset mounted within the associated excavating wheel and drivingly interconnected to the excavating wheel and the associated electric motor.

12. The excavating and loading system according to claim 10 wherein each of the speed reducer means comprises a pinion mounted on the output of the associated electric motor and a ring gear mounted within the associated excavating wheel and drivingly engaging the pinion.

13. An excavating and loading system comprising:

vehicle means having a main frame means supporting the frame for movement over a surface and having a predetermined length and a predetermined width;

excavating wheel means mounted at the front end of the vehicle means for rotation about an axis extending parallel to the width and perpendicular to the length of the vehicle;

said excavating wheel means comprising axle means, two rigid side excavating wheels mounted cantilever on the axle means and comprising the outermost structural components of the excavating and loading system, a third rigid excavating wheel supported on the axle means and extending between the two side excavating wheels, and spaced, parallel excavating wheel supporting and housing means extending between the center and the two side excavating wheels;

means including at least one electric motor and speed reducer means driven thereby for rotating the excavating wheels so that the digging buckets follow a circular path;

engine means mounted on the vehicle means;

electrical generator means mounted on the vehicle and driven by the engine means for supplying operating power for the electric motor;

each of said excavating wheels further comprising a plurality of digging buckets with the digging buckets of the side excavating wheels spanning continuously from the outer ends of the excavating wheel means to points immediately adjacent the supporting and housing means and with the digging buckets of the center excavating wheel spanning continuously between points immediately adjacent the two supporting and housing means;

the digging buckets each comprising a rear wall mounted for movement between a material receiving position and a material discharging position;

means located within the margins of the excavating wheel means and responsive to rotation of the excavating wheel means relative to the vehicle for positively actuating the movable wall of each digging bucket to the material discharging position during each rotation thereof;

conveyor means mounted on the vehicle behind the excavating wheel means for receiving material from the center excavating wheel and for carrying the material upwardly and rearwardly to a discharge point at the rear of the vehicle; and means mounted on the vehicle behind the excavating wheel means for receiving material from the two side excavating wheels and for directing the material to the conveyor means for transportation thereby to the discharge point.

14. The excavating and loading system according to claim 13 further including at least one electric motor operatively connected to the supporting means for propelling the vehicle.

15. The excavating and loading system according to claim 13 wherein the drive means is further characterized by:

dual electric motor means;

dual drive shaft means each drivingly connected to one of the electric motor means and each extending between the center excavating wheel and one of the two side excavating wheels of the excavating wheel assembly;

a pair of right angle drive means each drivingly connected to one of the drive shaft means and each having dual outputs extending substantially transversely to the drive shafts and into the excavating wheels; and the speed reducer means comprising three speed reducer devices each individual to and mounted within one of the excavating wheels and each drivingly interconnected at least one of the outputs of the right angle drive means and the surrounding excavating wheel to effect rotation of the excavating wheel under the action of the electric motor means.

16. The excavating and loading system according to claim 13 wherein the drive means is further characterized by three electric motors each mounted within one of the excavating wheels of the excavating wheel assembly and individual thereto, and three speed reducer devices each mounted within one of the excavating wheels of the excavating wheel assembly and individual thereto, and each drivingly interconnecting the associated electric motor and the associated excavating wheel to effect rotation of the excavating wheel under the action of the electric motor.

17. The excavating and loading system according to claim 13 wherein each of the speed reducer means comprises a planetary gearset mounted within the associated excavating wheel and drivingly interconnected the excavating wheel and the associated electric motor.

18. The excavating and loading system according to claim 13 wherein each of the speed reducer means comprises a pinion mounted on the output of the associated electric motor and a ring gear mounted within the associated excavating wheel and drivingly engaging the pinion.

* * * * *